US006102588A

United States Patent [19]

Verlinden et al.

[11] Patent Number: 6,102,588

[45] Date of Patent: Aug. 15, 2000

[54] APPARATUS FOR THE PROCESSING OF PHOTOGRAPHIC SHEET MATERIAL

[75] Inventors: Bartholomeus Verlinden, Tongeren; Patrick Van den Bergen, Hove, both of Belgium

[73] Assignee: Agfa-Gevaert, Mortsel, Belgium

[21] Appl. No.: 08/795,836

[22] Filed: Feb. 8, 1996

[30] Foreign Application Priority Data

Feb. 8, 1996 [EP] European Pat. Off. ..... 96200276

[51] Int. Cl.[7] ..... G03D 3/08; G03D 3/02

[52] U.S. Cl. ..... 396/626; 396/636; 396/612

[58] Field of Search ..... 396/612, 614, 396/617, 620, 622, 636, 626

[56] References Cited

U.S. PATENT DOCUMENTS

| | | | |
|---|---|---|---|
| 3,057,282 | 10/1962 | Luboshez | 396/636 |
| 4,324,479 | 4/1982 | Sachs | 396/622 |
| 4,616,915 | 10/1986 | Norris | 396/617 |
| 5,140,355 | 8/1992 | Haag et al. | 396/612 |
| 5,528,329 | 6/1996 | Sawada et al. | 396/622 |

FOREIGN PATENT DOCUMENTS

| | | |
|---|---|---|
| 0348869 | 1/1990 | European Pat. Off. . |
| 0594895 | 5/1994 | European Pat. Off. . |
| 0622677 | 11/1994 | European Pat. Off. . |
| 0647882 | 4/1995 | European Pat. Off. . |

*Primary Examiner*—D. Rutledge
*Attorney, Agent, or Firm*—Baker Botts L.L.P.

[57] ABSTRACT

An apparatus for the processing of photographic sheet material comprises a plurality of treatment cells (12[1], 12[2], 12[3]) mounted one beside another to define a substantially horizontal sheet material path (14). Each cell comprises a housing (16) having a sheet material inlet (18) and a sheet material outlet (20) each being closed by a rotatable path-defining roller (28) biased into contact with a reaction surface (26) to form a nip (30) there-between through which the sheet material path (14) extends. The apparatus is characterized by sealing means (33) to seal each path-defining roller (28) to the housing (16) and means (36) to define a static liquid level (S) above the nip plane (P).

21 Claims, 4 Drawing Sheets

APPARATUS FOR THE PROCESSING OF PHOTOGRAPHIC SHEET MATERIAL

FIELD OF THE INVENTION

The present invention relates to an apparatus for the processing of photographic sheet material, such as X-ray film, pre-sensitised plates, graphic art film and paper, and offset plates. More particularly the invention relates to improvements in apparatus in which photographic material is transported through one or more treatment units.

BACKGROUND OF INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

Apparatus for the processing of photographic sheet material such as aluminium lithographic printing plates is known, for example from EP-A-410500 (Agfa Gevaert NV), comprising a plurality of treatment vessels mounted one beside another to define a substantially horizontal sheet material path through the apparatus. Each vessel comprises a housing having a sheet material inlet and a sheet material outlet. The inlet and outlet are each closed by a pair of rotatable path-defining rollers biased into contact with each other to form a nip there-between through which the sheet material path extends.

The path-defining rollers are used to remove excess treatment liquid from the sheet as it passes from one treatment vessel to the next. This reduces carry-over of treatment liquid and thereby reduces contamination and wastage. A good removal of processing liquid is also required to reduce the drying time of the sheet material after the last process bath, and hence to reduce the energy use.

OBJECTS OF INVENTION

It is desirable that the treatment liquid in one vessel is not contaminated by contents of the adjacent vessels, that is neither by the treatment liquid of an adjacent vessel nor by vapours escaping from one vessel to another. Furthermore, in order to reduce consumption of treatment liquids, it is desirable to reduce the evaporation, oxidation and carbonisation thereof.

SUMMARY OF THE INVENTION

We have discovered that contamination, evaporation, oxidation, carbonisation and other chemical effects and thermodynamic effects can be reduced in a simple manner by a particular construction of the apparatus.

According to the invention there is provided an apparatus for the processing of photographic sheet material, comprising a plurality of treatment cells mounted one beside another to define a substantially horizontal sheet material path through the apparatus, wherein at least one of the cells comprises a housing having a sheet material inlet and a sheet material outlet each being closed by a rotatable path-defining roller biased into contact with a reaction surface to form a nip there-between through which the sheet material path extends, thereby to define a nip plane, characterised by sealing means to seal each path-defining roller to the housing and liquid level control means to define a static liquid level above the nip plane.

By providing a gas- and liquid-tight seal between the rollers on the one hand and a wall of the housing on the other, treatment liquid in one vessel is not contaminated by the contents of adjacent vessels.

The reaction surface towards which the path-defining roller is biased to define the nip will usually be another roller, or the reaction surface may be in the form of a belt or a fixed surface with a low friction coefficient. Where this general description refers to the use of two rollers, it is to be understood that the second roller may be replaced by any other reaction surface, such as those referred to above, so far as the context allows.

Where the reaction surface is constituted by a second path-defining roller, it is preferable to provide second sealing means to seal each second path-defining roller to the housing. The second sealing means may be located below the static liquid level, although it is also possible to arrange that the static liquid level is below the second sealing means.

The housing of the apparatus is a static structure which serves to support the path-defining rollers. Preferably, the housing includes an upper portion closing the cell from the outside. The static liquid level may correspond to the location of the upper portion of the cell, or there may be an air gap there-between. Even in the case of an air gap being present, any evaporation of the treatment liquid in the cell is brought quickly to a stop. The housing may include a treatment liquid circulation passage located below the static liquid level and the upper portion of the housing may include means to facilitate depressurising the cell, such as a closeable valve.

The sealing means preferably contacts the path defining roller at a position located less than 180°, such as between 45° and 135° from the nip on the liquid side, or on the non-liquid side. This arrangement enables the path-defining rollers to be moved away from each other, and from the sealing means, for reasons explained below.

Each of the sealing means may comprise a rotatable sealing member, such as a sealing roller, in contact with the rotatable path-defining roller along its length. Preferably, the sealing roller is carried by a longitudinal bearing which constitutes a stationary sealing member. By the use of a rotatable sealing member in place of a stationary sealing member, the torque which needs to be applied to the path-defining roller can be significantly reduced. This reduces the power needed by the processor, reduces wear on the path-defining roller, reduces the mechanical deformation thereof and thereby extends the expected life time. This construction also improves the control of pressure distribution over the sheet material.

In particular, the sealing roller may have a diameter less than that of the path-defining roller. For example, the sealing roller may have a diameter which is from one tenth to one third of the diameter of the path-defining roller, thereby enabling the torque which needs to be applied to be further reduced. The sealing roller preferably extends in a straight line parallel to the associated path-defining roller axis.

The sealing roller may he formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni-PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In an alternative sealing arrangement, the sealing of the path-defining rollers to the housing can be achieved in a simple and reliable manner whereby the path-defining rollers are substantially equal in length and are axially offset relative to each other and each roller is in sealing contact along its length, at least between the limits of the nip, with a stationary sealing member.

In this arrangement, the sealing member preferably includes a portion which extends longitudinally along the surface of the associated roller. This longitudinal part of the sealing member may extend in a straight line parallel to the associated roller axis.

The stationary sealing member may be carried on a sealing support, secured within the cell.

By arranging for the rollers to be axially offset with respect to each other, it is possible that the stationary sealing member may include a portion which extends circumferentially around the surface of its associated roller. To ensure a good seal at this point, the sealing support may be in contact with the end face of the opposite roller. Means, such as sinus springs incorporated in the roller mountings, may be provided for pulling each of the rollers against a respective end plate of the sealing support with a force of from 2 to 500 g/cm of contact between the end plate and the end face of the roller, measured at the surface of the roller. In order to reduce the torque required to rotate the rollers, the ratio of the roller diameter $\phi$ to the length of the nip is preferably greater than 0.012.

The stationary sealing member in such an arrangement may be in a unitary or composite form which exerts a spring force of between 2 and 500 g/cm of roller, perpendicular to the roller surface. The spring loading may be derived from the geometry of a unitary sealing member, from a separate spring incorporated in a composite sealing member or simply from compression of the elastomeric material covering of the associated roller. The sealing member material which is in contact with the associated roller surface preferably has a coefficient of friction (as measured against stainless steel) of from 0.05 to 0.3, preferably from 0.09 to 0.2. The sealing member material in contact with the associated roller surface may comprise a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In an alternative sealing arrangement, where the reaction surface is constituted by another path-defining roller and these rollers are positioned relative to each other such that end faces of one roller lie in substantially the same planes as end faces of the other roller, the sealing of the rollers to the housing of the cell is achieved in a simple and reliable manner whereby stationary sealing means are provided in contact with each roller, having a continuous contact line which extends along the length of each roller and over the end faces of each roller, at least on the liquid side of the nip.

The stationary sealing means used in this arrangement may contact each roller along a straight line parallel to the associated roller axis. The stationary sealing means may be in a unitary or multi-part form. In particular, a unitary stationary sealing member may comprise a central portion in the form of a substantially horizontally disposed flat plate, the under faces of which contact the surface of each roller, the stationary sealing member further comprising substantially vertically disposed end plates which bear against the end faces of the rollers. The stationary sealing member preferably exerts a spring force of between 2 and 500 g/cm of roller, perpendicular to the roller surface. The spring loading may be derived from the geometry of a stationary sealing member, from a separate spring incorporated in a stationary sealing member or simply from compression of the elastomeric material covering of the associated roller.

The end plates are preferably biased against the end faces of the rollers with a force of from 2 to 500 g/cm of contact between the end plate and the end face of the roller, measured on the surface of the roller. Thus, the end plates may be urged against the end faces of the rollers by springs so shaped to ensure the desired location of the contact line between the end plates and the end faces of the rollers. Alternatively the elastomeric material covering of the rollers is somewhat oversized, the necessary spring force then being derived from the elasticity of the elastomeric material itself.

The stationary sealing member in this embodiment is formed of, or is provided with, a roller-contacting surface formed of a material which preferably has a coefficient of friction (as measured against stainless steel) of from 0.05 to 0.3, preferably from 0.09 to 0.2. The stationary sealing member material in contact with the associated roller surface may comprise a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof. Alternatively or additionally, those surfaces of the roller which contact the stationary sealing member may be coated with such a low-friction material.

The apparatus may further comprise means for selectively moving the path-defining rollers away from each other to enable the cell to be more easily cleaned and to remove the necessity for the rollers to remain in contact with each other when the apparatus is idle. In one embodiment of the roller opening means, the path-defining rollers are rotatable on respective roller shafts, the rollers being biased together. At least one end of the first roller shaft is provided with a rotational drive means for transporting the sheet material in the processing direction. At each end of the second roller shaft displacement means are provided, for relative displacement of the second roller away from and to the first roller.

In an alternative embodiment of the roller opening means, the path-defining rollers are rotatable on respective roller shafts. Cooperating cams are provided at each end of the roller shafts. The cams on the first roller shaft are circular cams, fixedly secured to the roller shafts. The cams on the second shaft are eccentric cams, connected to the second shaft by way of a one-way clutch. In the normal direction of rotation of the rollers, the eccentric cam is free to rotate relative to the second roller shaft. However, if the direction of rotation of the second roller shaft is reversed, the one-way clutch engages to rotationally secure the eccentric cam to the second roller shaft. Rotation of the eccentric cam in this reverse direction causes the rollers to move away from each other. Where such a construction of the roller opening means is provided for a number of cells, the one-way clutches may be set in relation to each other to open the rollers of these cells in sequence. To open the rollers in sequence, it is then simply necessary to drive the rollers step-wise in the reverse direction. An encoder on the shaft of the drive motor may be provided to assist the control of this operation.

Preferably, at least one of the path-defining rollers constitutes a drive roller for driving the sheet material along the sheet material path. Constituting the roller as a drive roller enables the cell to be constituted in a particularly simple manner. Alternatively, the rollers may be freely rotating, alternative drive means being provided to drive the photographic sheet material through the apparatus.

It is important to avoid, or at least minimise, leakage of treatment liquid from one cell to another and carry-over as the sheet material passes through the apparatus. Typical rollers have a core provided with a covering of elastomeric material, although it is possible for the roller to be elastomeric throughout its cross-section. As the sheet material leaves a given liquid treatment vessel it is necessary to remove any liquid carried on the sheet material as efficiently as possible, to prevent carry-over of liquid into a next treatment cell and to reduce edge effects which arise from non-homogeneous chemistry on the sheet material after squeegeeing. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm or more and a diameter of from 24 to 30 mm. The sheet material typically has a width of from a few millimeters up to 2 m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the roller to its length is above a critical limit.

According to a preferred embodiment of the invention therefore, at least one of the rollers, and preferably each roller, comprises a rigid core carrying a covering of elastomeric material, the ratio ($\phi$/L) of the maximum diameter ($\phi$) of the elastomeric material covering to the overall length (L) thereof being at least 0.012, most preferably between 0.03 and 0.06. It is preferred that the roller requirements referred to above apply to the second roller also. Indeed, it will be usual for the two rollers to be identical, although it is possible that the diameters ($\phi$), and therefore the ratios ($\phi$/L), of the two rollers need not be identical. It is also possible that the reaction surface may be formed by the surface of a second roller which does not conform to the above requirements, such as for example, a roller having no elastomeric covering.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment of the invention, the diameter ($\phi$) of the elastomeric material covering is constant along the length of the roller. Alternatively the roller may have a radial dimension profile which varies along the length thereof. In the latter case, the diameter ($\phi$) in the expression $\phi$/L is the maximum diameter. In a preferred embodiment, such a roller comprises a non-deformable core, the thickness of the elastomeric material covering varying along the length thereof. Alternatively or additionally, the diameter of the core varies along the length thereof.

Ideally, the radial dimension profile of such a roller is such in relation to the force applied by the roller to sheet material passing through the nip as to be substantially even over the width thereof.

The radial dimension of the roller ideally decreases towards the ends thereof i.e. a convex profile, especially a parabolic profile.

Preferably, the core has a flexural E-modulus of between 50 GPa and 300 Gpa. Suitable materials for the rigid core include metals, such as stainless steel, non-ferrous alloys, titanium, aluminium or a composite thereof or a composite material of fibres such as carbon fibres and a resin matrix.

In one embodiment of the invention, the core is hollow, in order to reduce the weight thereof. Alternatively the core may be solid, thereby to improve the strength thereof.

In a preferred embodiment of the invention, the rollers are substantially equal in length. Where the rollers are of different lengths, and/or are offset, the length of the nip between them is less than the roller length. In this case it is preferred that the ratio of the roller diameter $\phi$ to the length of the nip is greater than 0.012.

The rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

Each path-defining roller may be a small diameter, light weight roller comprising a core provided with a covering of relatively soft material, having an effective length ($\lambda$) of from 0.4 to 2.0 m, the core having a maximum diameter ($\phi$) of less than 0.04*$\lambda$ m, characterised by being so constructed that the deflection ($\Delta$) of the roller (m) as measured by ASTM D 790M is given by the following boundary condition formula:

$$\Delta < \frac{\lambda^3 C[W - \lambda F]}{\kappa_{23} - \kappa_{24} D} + \frac{\kappa_{22}\lambda^4}{G} \tag{1}$$

wherein:

$$C = \frac{\kappa_3 D^3 - \kappa_4 D^2 + \kappa_5 D - \kappa_6}{\kappa_7 D^6 - \kappa_8 D^5 + \kappa_9 D^4 - \kappa_{10} D^3 + \kappa_{11} D^2 - \kappa_{12} D + \kappa_{13}};$$

$$F = (\kappa_{14} T + \kappa_{15}) D + \kappa_{16} T^2 - \kappa_{17};$$

$$G = \kappa_{18} D^3 - \kappa_{19} D^2 + \kappa_{20} D - \kappa_{21}; \text{ and}$$

$T$ = the maximum thickness of said relatively soft covering ($m$);

$W$ = the weight of the roller ($kg$);

-continued and $\kappa_3 = 4.0*10^8$; $\kappa_4 = 4.2*10^6$; $\kappa_5 = 1.48*10^4$; $\kappa_6 = 17.5$;

$\kappa_7 = 1.92*10^{18}$; $\kappa_8 = 2.02*10^{16}$; $\kappa_9 = 9.98*10^{13}$;

$\kappa_{10} = 2.86*10^{11}$; $\kappa_{11} = 4.92*10^8$; $\kappa_{12} = 4.84*10^5$;

$\kappa_{13} = 207$; $\kappa_{14} = 2.69*10^3$; $\kappa_{15} = 34.9$; $\kappa_{16} = 2.69*10^3$;

$\kappa_{17} = 5.24*10^{-2}$; $\kappa_{18} = 1.2*10^9$; $\kappa_{19} = 5.4*10^6$;

$\kappa_{20} = 1.08*10^4$; and $\kappa_{21} = 8.1$, $\kappa_{22} = 38.4$;

$\kappa_{23} = 1.06*10^{-3}$; and $\kappa_{24} = 3.03*10^{-1}$.

As a consequence of the boundary condition formula (1), the weight (W) of the roller is subject to a maximum, (i.e. when Δ=0), which is given by the boundary condition formula:

$$W < \lambda\left[F - \frac{\kappa_1 - \kappa_2 D}{GC}\right] \text{ (kg)}, \tag{2}$$

wherein $\kappa_1 = 4.07*10^{-2}$ and $\kappa_2 = 11.6$.

Thus it will be noted that the boundary condition formulae quoted above are such as to impose a maximum weight on the roller and that therefore formula (1) defines rollers which are relatively light. For the sake of completeness it may be noted that the weight (W) of the roller cannot be negative and the deflection (Δ) will also not be negative.

For the sake of clarity, it should be noted that the dimensions φ, λ and T used in boundary condition formulae (1) and (2) are expressed in meters, giving a deflection in meters and a weight in kilograms.

The effective length of the roller (λ), as the term is used in formulae (1) and (2), is defined as the length of that part of the core which is covered with the relatively soft covering, minus 0.02 m at each side. This allows for the fact that, in practise, in the ASTM test referred to above, the roller is not supported at its absolute ends, but rather at points situated just before each end. For similar reasons, the weight of the roller is defined as the weight of the core and the covering, cut to the effective length λ, without spindles or bearings.

At least one of the path-defining rollers and the reaction member may comprise an inner region of elastomeric material having a relatively low hardness, and an outer region of elastomeric material having a relatively high hardness positioned over the inner region. The two regions of elastomeric material will usually be constituted by distinguishable layers, but it is also possible to use a single layer of elastomeric material which is so formed to have a hardness which varies throughout its thickness.

It is preferred that both the path-defining roller and the reaction member comprise the inner region of elastomeric material having a relatively low hardness, and the outer region of elastomeric material having a relatively high hardness positioned over the inner region. The Shore-A hardness of the inner region may be less than 50, preferably from 15 to 45, while the Shore-A hardness of the outer region may be more than 25, preferably from 40 to 90. Where the inner and outer regions are constituted by distinguishable layers, the difference between the Shore-A hardness of the inner layer and the outer layer may be at least 5, most preferably at least 10. Elastomeric materials having a low Shore-A hardness provide elastomeric properties consistent with the objective of low carry-over, but low molecular weight compounds tend to diffuse in use into the treatment baths so that these elastomeric properties are lost while both chemical and physical wear resistance are low. The provision according to the invention of the outer region of elastomeric material having a higher Shore-A hardness reduces these negative effects, surprisingly without significantly increasing carry-over and enables grinding to a desired surface quality. More specifically, optimal grinding of the elastomeric material improves the hydrophilicity of the material by stabilising its surface roughness and also reduces the torque required to drive the roller by lowering its rolling resistance. The use of elastomeric materials with relatively high hardness improves the stability to oxygen and ultra violet light, reduces evaporation of elastomeric compounds from the surface and reduces the diffusion of treatment liquids through the material. The performance and useful life of the roller can therefore be optimised.

Where the inner and outer regions are constituted by distinguishable layers, the inner layer may have a thickness which may be from 5% to 35%, such as from 10% to 20% of the roller diameter, that is at least 1.0 mm, such as from 4 mm to 8 mm for a typical roller having a diameter of 40 mm. The outer layer may have a thickness which may be from 1% to 10% of the roller diameter, that is at least 0.2 mm for the typical roller. Below this thickness, the elastomeric effect may be lost, and grinding to a desired profile becomes difficult or impossible.

Such rollers exhibit good stability against treatment liquids and have good processing qualities.

Each path-defining roller may comprise an outer region of elastomeric material, at least a portion of which contains potassium titanate whiskers. The potassium titanate whiskers are known in the art as TISMO which is generally expressed by the formula $K_2O.nTiO_2$, especially TISMO D (n=8). It is a microfine whisker having a typical whisker diameter of from 0.3 to 0.6 μm and a whisker length of from 10 to 20 μm. While its use in composite plastics materials has been proposed, its beneficial properties when incorporated in the elastomeric outer region of a roller of a sheet material handling apparatus, especially the reduction in the wear of the elastomer and lowering of friction, have not previously been appreciated. Wear on the roller is thereby reduced.

The means to define a static liquid level above the nip plane may comprise a treatment liquid overflow provided in the housing at a level above the nip plane. Treatment liquid passing through the overflow may be recycled if desired. Alternatively or additionally, the apparatus may further comprise sensing means for sensing the level of treatment liquid in the cell and control means, responsive to the output of the sensing means, to adjust the level of treatment liquid in the cell to a predetermined level.

Usually each cell of the apparatus is constructed as aforesaid. However, some cells may be of different construction, adapted for example as cells in which no liquid immersion treatment of the sheet material takes place. Such alternative cells may include means for spraying a treatment liquid directly on to the sheet material or may simply constitute intermediate buffer cells where diffusion reactions take place on the sheet material prior to contact with treatment liquid in the next adjacent cell. The cells may also include additional features if desired. Cleaning means may be provided for acting upon the rollers to remove debris therefrom, as described in European patent application EP 93202862 (Agfa-Gevaert NV), filed Oct. 11, 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Guide means may be included for guiding the passage of the sheet material through the apparatus.

Heating means may be provided in one or more cells so that the cell becomes a sheet material drying unit, rather than a wet treatment unit. While liquid pumping, heating, cooling and filtering facilities will normally be provided outside the cells, it is possible for some elements of these features to be included in the cells themselves. Any combination of these additional features is also possible.

The present invention enables the sheet material path through the plurality of cells to be substantially straight. A straight path is independent of the stiffness of the sheet material and reduces the risk of scratching compared with a circuitous path.

The cells may be separated from each other by one or more intermediate regions, especially between developer and fixer cells. It may on the other hand be unnecessary to provide an intermediate region between the fixer and wash cells. It is advantageous to connect each cell to adjacent cells in the apparatus in a closed manner. By the term "closed manner" in this specification is meant that each cell is so connected to adjacent cells that no cell is open to the environment. By connecting cells together in this manner, the evaporation, oxidation and carbonization of treatment liquids can be significantly reduced. This may be achieved according to a preferred embodiment of the present invention, in that one of the cells may be spaced from the next adjacent cell by a closed intermediate region. It may also be advantageous to provide a closed entry region in advance of the first treatment cell and/or a closed exit region following the final treatment cell, thereby to protect the treatment cells from the environment.

Preferably, a first drip tray is provided in the intermediate region below the nip of the sheet material outlet of the one cell and a second drip tray is provided in the intermediate region below the nip of the sheet material inlet of the next adjacent cell.

Each cell may be of modular construction and provided with means to enable the cell to be mounted directly beside an identical or similar other cell. Alternatively, the apparatus may take an integral or semi-integral form in which the means for connecting each cell to adjacent cells in a closed manner is constituted by common housing walls of the apparatus. By the term "semi-integral form" we intend to include an apparatus which is divided by a substantially horizontal plane passing through all the vessels in the apparatus, particularly the plane of the sheet material path, enabling the apparatus to be opened up for servicing purposes, in particular to enable easy access to the rollers.

A convenient arrangement for the processing of photographic sheet material may comprise a first vertical processing apparatus in which the sheet material passes along a substantially vertical path coupled to a horizontal processing apparatus according to the invention. The horizontal apparatus may in turn be coupled to a second vertical processing apparatus. For example, the first vertical processing apparatus is adapted for the development of images on the photographic sheet material and will therefore include one or more vessels containing developer solution, the horizontal processing apparatus is adapted for the fixing of developed images on the photographic sheet material and will therefore include two or more vessels containing fixing solution, and the second vertical processing apparatus is adapted for the cascade washing and optionally drying of the photographic sheet material.

The present invention also provides a method for the processing of photographic sheet material, in an apparatus comprising a plurality of treatment cells mounted one beside another to define a substantially horizontal sheet material path through the apparatus, wherein at least one of the cells comprises a housing having a sheet material inlet and a sheet material outlet each being closed by a rotatable path-defining roller biased into contact with a reaction surface to form a nip there-between through which the sheet material path extends, thereby to define a nip plane, characterised by sealing each of the path-defining rollers to the housing and controlling a static liquid level above the nip plane.

In the method according to the invention, the sheet material is fed into the apparatus at a level below the static liquid level and therefore processing takes place below this level. It is preferable that, during operation of the apparatus, the dynamic liquid level is also above the nip plane. Uniform processing of the sheet material can thereby be assured.

The apparatus according to the invention may be cleaned from time to time by draining treatment liquids from the cells, optionally to a storage container for later re-use, adding cleaning liquid, such as water, to one of the cells, and pumping such cleaning liquid to the other cells in the apparatus in turn. Such a cleaning method makes economical use of the cleaning liquid.

The apparatus according to the invention may be adapted in that means are provided to circulate the treatment liquids (including wash water) through the treatment cells and means are provided to maintain the treatment liquids at a predetermined temperature. After passing through the treatment liquids, the sheet material is dried in a drying cell. Such an apparatus may be operable in at least two selectable modes. In a "standby" mode the treatment liquids are maintained at their respective predetermined temperatures. In an "operating" mode additionally the treatment liquid is circulated through the treatment cell or cells, sheet material is driven through the apparatus and the drying unit is operated.

In such an apparatus a large proportion, perhaps 90%, of the energy consumption in the operating mode derives from operation of the drying unit. We therefore prefer that the apparatus is so constructed that the energy consumption $E_{OP}$ per unit area of sheet material being processed in the operating mode is as low as possible and the energy consumption $E_{SB}$ in the standby mode is also as low as possible.

In the above definition $E_{OP}$ is the energy consumed by the specified features of the apparatus in the operating mode, namely maintaining the treatment liquids at their respective predetermined temperatures, circulating the treatment liquids through the treatment cells, driving the sheet material through the apparatus and operating the drying means. Thus $E_{OP}$ does not represent the total energy consumption of the system since it does not take into account energy losses for other reasons, such as the energy consumed in the preparation of the treatment liquids, or in the disposal thereof. Similarly, $E_{SB}$ is the energy consumed by the specified features of the apparatus in the standby mode, namely only that energy used to maintain the treatment liquid and the wash water at their respective predetermined temperatures.

Since the energy consumption of the apparatus in either mode may be dependent upon the environmental conditions, we specify that these measurements are made under conditions where the external temperature is 15° C., the relative humidity is 20% and the air is still. Since the energy consumption of the apparatus in either mode may vary with time, we specify that the energy consumption $E_{SB}$ in the standby mode is taken as the average energy consumption over 24 hours of zero throughput and the energy consumption $E_{OP}$ in the operating mode is taken as the average energy consumption over 24 hours of continuous throughput at a given sheet speed through the apparatus.

That feature of the apparatus which is particularly important in reducing energy consumption, is the construction wherein each cell is closed to the environment. Thereby, the evaporation, oxidation and carbonisation of treatment liquids and any other undesirable exchange between the treatment liquid and the environment can be significantly reduced.

The method according to the invention may include a measuring step in which the throughput of photographic sheet material through a given cell over a given period of time is measured, a regeneration step in which fresh treatment liquid is added to that cell in an amount calculated from the measured throughput of photographic sheet material to maintain the concentration of active ingredients in that cell substantially constant by weight, and a top-up step in which further fresh treatment liquid is added to that cell to compensate for any loss in treatment liquid level within that cell.

The apparatus and method described herein can be used to process a number of different types of photographic sheet material, including for example X-ray film, one- and two-sheet DTR sheet materials, lithographic plates and graphic arts sheet materials, the details of the apparatus being modified as desired according to the intended use.

For X-ray applications, processing conditions and the composition of processing solutions are dependent on the specific type of photographic material. For example, materials for X-ray diagnostic purposes may be adapted to rapid processing conditions. Preferably the processing apparatus is provided with a system for automatic regeneration of the processing solutions. The material may be processed using one-part package chemistry or three-part package chemistry, depending on the processing application determining the degree of hardening required in the processing cycle. Applications within total processing times of 30 seconds and higher up to 90 seconds, known as common practice, are possible. The processing may take place in a glutaraldehyde containing hydroquinone/1-phenyl-3-pyrazolidinone developer marketed by Agfa-Gevaert NV under the Trade Name G138 having a high activity or in a cheap developer with a low activity having the following composition amounts given in g/l.

| | |
|---|---|
| hydroquinone | 13.3 |
| phenidone | 0.8 |
| sodium metabisulphite | 29.7 |
| ethylenediamine tetraacetic acid, tetrasodium salt trihydrate | 1.33 |
| potassium hydroxide | 27.9 |
| sodium tetraborate decahydrate | 8.8 |
| acetic acid | 5.2 |
| 5-methylbenzotriazole | 0.04 |
| 5-nitrobenzimidazole | 0.05 |
| glutaraldehyde | 3.0 |
| diethylene glycol | 12.8 |

Another suitable developer composition for X-ray sheets is the following:

| | |
|---|---|
| Composition A | |
| potassium hydroxide composition (0.76 g/ml) | 74 ml |
| demineralised water | 100 ml |
| potassium sulphite solution (0.655 g/ml) | 390 ml |
| Trilon B (0.524 g/l) | 16 ml |
| Turpinol 2 NZ | 4 g |
| diethyleneglycol | 100 ml |
| potassium chloride | 3.2 g |
| potassium carbonate solution (0.765 g/ml) | 168 ml |
| hydroquinone | 120 g |
| Cobratec TT 100 | 0.36 g |
| demineralised water to | 1000 ml |
| Composition B | |
| acetic acid 99% | 38 ml |
| phenidone | 6 g |
| 5 nitro-indazol | 1 g |
| polyethylene glycol 350 | 1 ml |
| diethylene glycol to | 100 ml |
| Composition C | |
| glutaraldehyde | 76 ml |
| potassium metabisulphite | 36 g |
| demineralised water to | 100 ml |

Before use, 1 l of composition A is mixed with 2.8 l water, 100 ml composition B and 100 ml composition C.

Another suitable developer solution for X-ray sheets is the following:

| | |
|---|---|
| Composition A | |
| ammonium thiosulphate solution (0.778 g/ml) | 880 ml |
| sodium sulphite (anhydrous) | 54 g |
| boric acid (sieved) | 25 g |
| sodium acetate 3 aq. | 70 g |
| acetic acid 96% | 40 ml |
| demineralised water to | 1000 ml |
| Composition B | |
| demineralised water | 110 ml |
| acetic acid 96% | 40 ml |
| aluminium sulphate solution (0.340 g/l) | 100 ml |

Before use, 3.750 l water is mixed with 1 l composition A and 0.25 l composition B.

Photographic sheet materials designed for one sheet silver complex diffusion transfer reversal process (DTR process) may be developed with the aid of an aqueous alkaline solution in the presence of (a) developing agent(s) and (a) silver halide solvent(s).

Preferably the silver halide solvent is used in an amount between 0.01% by weight and 10% by weight and more preferably between 0.05% by weight and 8% by weight. Suitable silver halide solvents for use in connection with the present invention are e.g. 2-mercaptobenzoic acid, cyclic imides, oxazolidones and thiosulphates. Silver halide solvents that are preferably used are thiocyanates and alkanolamines.

Alkanolamines that are suitable for use in DTR processing may be of the tertiary, secondary or primary type. Examples of alkanolamines that may be used correspond to the following formula:

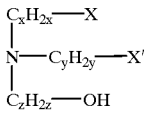

wherein X and X' independently represent hydrogen, a hydroxyl group or an amino group, x and y represent 0 or integers of 1 or more and z represents an integer of 1 or more. Preferably used alkanolamines are e.g. N-(2-aminoethyl)ethanolamine, diethanolamine, N-methylethanolamine, triethanolamine, N-ethyldiethanolamine, diisopropanolamine, ethanolamine, 4-aminobutanol, N,N-dimethylethanolamine, 3-aminopropanol, N,N-ethyl-2,2'-iminodiethanol, 2-aminoethyl-aminoethanol etc. or mixtures thereof.

The alkanolamines are preferably present in the alkaline processing liquid. However part or all of the alkanolamine can be present in one or more layers of the imaging element.

A further suitable type of silver halide solvents are thioether compounds. Preferably used thioethers correspond to the following general formula:

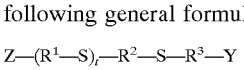

wherein Z and Y each independently represents hydrogen, an alkyl group, an amino group, an ammonium group, a hydroxyl, a sulpho group, a carboxyl, an aminocarbonyl or an aminosulphonyl, $R^1$, $R^2$ and $R^3$ each independently represents an alkylene that may be substituted and optionally contain an oxygen bridge and t represents an integer from 0 to 10. Examples of thioether compounds corresponding to the above formula are disclosed in e.g. U.S. Pat. No. 4,960,683 and European patent application EP-A-547662, which therefor are incorporated herein by reference.

Still further suitable silver halide solvents are meso-ionic compounds. Preferred meso-ionic compounds for use in connection with DTR processing are triazolium thiolates and more preferred 1,2,4-triazolium-3-thiolates.

At least part and most preferably all of the meso-ionic compound is present in the alkaline processing liquid used for developing the image-wise exposed imaging element. Preferably the amount of meso-ionic compound in the alkaline processing liquid is between 0.1 mmol/l and 25 mmol/l and more preferably between 0.5 mmol/l and 15 mmol/l and most preferably between 1 mmol/l and 8 mmol/l.

However the meso-ionic compound may be incorporated in one or more layers comprised on the support of the imaging element. The meso-ionic compound is in that case preferably contained in the imaging element in a total amount between 0.1 and 10 mmol/$m^2$, more preferably between 0.1 and 5 mmol/$m^2$ and most preferably between 0.5 and 1.5 mmol/$m^2$. More details are disclosed in European patent application EP-A-554585.

The alkaline processing liquid used preferably has a pH between 9 and 14 and more preferably between 10 and 13. The pH may be established by an organic or inorganic alkaline substance or a combination thereof. Suitable inorganic alkaline substances are e.g. potassium or sodium hydroxide, carbonate, phosphate etc. Suitable organic alkaline substances are e.g. alkanolamines. In the latter case the alkanolamines will provide or help maintain the pH and serve as a silver halide complexing agent.

The alkaline processing liquid may also contain (a) developing agent(s). In this case the alkaline processing liquid is called a developer. On the other hand some or all of the developing agent(s) may be present in one or more layers of the photographic material or imaging element. When all of the developing agents are contained in the imaging element the alkaline processing liquid is called an activator or activating liquid.

Silver halide developing agents for use in accordance with the present invention are preferably of the p-dihydroxybenzene type, e.g. hydroquinone, methylhydroquinone or chlorohydroquinone, preferably in combination with an auxiliary developing agent being a 1-phenyl-3-pyrazolidone-type developing agent and/or p-monomethylaminophenol. Particularly useful auxiliary developing agents are the 1-phenyl-3-pyrazolidones. Even more preferred, particularly when they are incorporated into the photographic material are 1-phenyl-3-pyrazolidones of which the aqueous solubility is increased by a hydrophilic substituent such as e.g. hydroxy, amino, carboxylic acid group, sulphonic acid group etc. Examples of 1-phenyl-3-pyrazolidones substituted with one or more hydrophilic groups are e.g. 1-phenyl-4,4-dimethyl-2-hydroxy-3-pyrazolidone, 1-(4-carboxyphenyl)-4,4-dimethyl-3-pyrazolidone etc. However other developing agents can be used.

At least the auxiliary developing agents are preferably incorporated into the photographic material, preferably in the silver halide emulsion layer of the photographic material, in an amount of less than 150 mg/g of silver halide expressed as $AgNO_3$, more preferably in an amount of less than 100 mg/g of silver halide expressed as $AgNO_3$.

The alkaline processing liquid used for developing a DTR imaging element preferably also contains hydrophobizing agents for improving the hydrophobicity of the silver image obtained in the image receiving layer. The hydrophobizing agents used in connection with DTR processing are compounds that are capable of reacting with silver or silver ions and that are hydrophobic i.e. insoluble in water or only slightly soluble in water. Generally these compounds contain a mercapto group or thiolate group and one or more hydrophobic substituents e.g. an alkyl group containing at least 3 carbon atoms. Examples of hydrophobizing agents for use in DTR processing are e.g. those described in U.S. Pat. No. 3,776,728, and U.S. 4,563,410. Preferred compounds correspond to one of the following formulae:

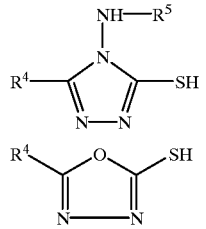

wherein $R^5$ represents hydrogen or an acyl group, $R^4$ represents alkyl, aryl or aralkyl. Most preferably used compounds are compounds according to one of the above formulas wherein $R^4$ represents an alkyl containing 3 to 16 C-atoms.

The hydrophobizing agents are contained in the alkaline processing liquid in an amount of at least 0.1 g/l, more preferably at least 0.2 g/l and most preferably at least 0.3 g/l. The maximum amount of hydrophobizing agents will be determined by the type of hydrophobizing agent, type and amount of silver halide solvents etc. Typically the concentration of hydrophobizing agent is preferably not more than 1.5 g/l and more preferably not more than 1 g/l.

The alkaline processing liquid preferably also contains a preserving agent having antioxidation activity, e.g. sulphite ions provided e.g. by sodium or potassium sulphite. For example, the aqueous alkaline solution comprises sodium sulphite in an amount ranging from 0.15 to 1.0 mol/l. Further may be present a thickening agent, e.g. hydroxyethylcellulose and carboxymethylcellulose, fog inhibiting agents, e.g. potassium bromide, potassium iodide and a benzotriazole which is known to improve the printing endurance, calcium-sequestering compounds, anti-sludge agents, and hardeners including latent hardeners. It is furthermore preferred to use a spreading agent or surfactant in the alkaline processing liquid to assure equal spreading of the alkaline processing liquid over the surface of the photographic material. Such a surfactant should be stable at the pH of the alkaline processing liquid and should assure a fast overall wetting of the surface of the photographic material. A surfactant suitable for such purpose is e.g. a fluorine containing surfactant such as e.g. $C_7F_{15}COONH_4$. It is furthermore advantageous to add glycerine to the alkaline processing liquid so as to prevent crystallization of dissolved components of the alkaline processing liquid.

Development acceleration can be accomplished by addition of various compounds to the alkaline processing liquid and/or one or more layers of the photographic element, preferably polyalkylene derivatives having a molecular weight of at least 400 such as those described in e.g. U.S. Pat. No. 3,038,805, U.S. 4,038,075, U.S. 4,292,400 and U.S. 4,975,354.

Subsequent to the development in an alkaline processing liquid in accordance with the present invention the surface of the printing plate is preferably neutralized using a neutralization liquid.

A neutralization liquid generally has a pH between 5 and 8. The neutralization liquid preferably contains a buffer e.g. a phosphate buffer, a citrate buffer or mixture thereof. The neutralization solution can further contain bactericides, substances which influence the hydrophobic/hydrophilic balance of the printing plate obtained after processing of the DTR element, e.g. hydrophobizing agents as described above, silica and wetting agents, preferably compounds containing perfluorinated alkyl groups.

The two-sheet DTR process is by nature a wet process including development of the exposed silver halide in the emulsion layer of the photosensitive element, the complexing of residual undeveloped silver halide and the diffusion transfer of the silver complexes into the image-receiving material wherein physical development takes place.

The processing proceeds in alkaline aqueous medium.

The developing agent or a mixture of developing agents can be incorporated into the alkaline processing solution and/or into the imaging material. When incorporated into the photosensitive element, the developing agent(s) can be present in the silver halide emulsion layer or is (are) preferably present in a hydrophilic colloid layer in water-permeable relationship therewith, e.g. in the anti-halation layer adjacent to the silver halide emulsion layer of the photosensitive element. In case the developing agent or a mixture of developing agents is in its total contained in the photosensitive element, the processing solution is merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol. Preferably used is a combination of a hydroquinone-type and 1-phenyl-3-pyrazolidone-type developing agent whereby the latter is preferably incorporated in one of the layers comprised on the support of the imaging material. A preferred class of 1-phenyl-3-pyrazolidone-type developing agents is disclosed in European patent application EP-A-498968.

The silver halide solvent, preferably sodium or ammonium thiosulphate, may be supplied from the non-light-sensitive image-receiving element as mentioned above, but it is normally at least partly already present in the alkaline processing solution. When present in the alkaline processing solution, the amount of silver halide solvent is in the range of e.g. 10 g/l to 50 g/l.

Preferred alkaline substances are inorganic alkali e.g. sodium hydroxide, sodium or potassium carbonate, sodium phosphate, sodium borate or alkanolamines or mixtures thereof. Preferably used alkanolamines are tertiary alkanolamines e.g. those described in European patent applications EP-A 397925, 397926, 397927 and 398435 and U.S. Pat. No. 4,632,896. A combination of alkanolamines having both a $pK_a$ above or below 9 or a combination of alkanolamines whereof at least one has a $pK_a$ above 9 and another having a $pK_a$ of 9 or less may also be used as disclosed in the Japanese patent applications laid open to the public numbers 73949/61, 73953/61, 169841/61, 212670/60, 73950/61, 73952/61, 102644/61, 226647/63, 229453/63, U.S. Pat. Nos. 4,362,811 and 4,568,634. The concentration of these alkanolamines is preferably from 0.1 mol/l to 0.9 mol/l.

The alkaline processing solution usually contains preserving agents e.g. sodium sulphite, thickening agents e.g. hydroxyethylcellulose and carboxymethylcellulose, fog-inhibiting agents such as potassium bromide, black-toning agents especially heterocyclic mercapto compounds, detergents e.g. acetylenic detergents such as SURFYNOL 104, SURFYNOL 465, SURFYNOL 440 etc. all available from Air Reduction Chemical Company, New York, USA.

The DTR-process is normally carried out at a temperature in the range of 10° C. to 35° C.

The pH of the processing solution is preferably in the range of 9 to 14, more preferably in the range of 10 to 13.

Photolithographic plates may be processed by compositions with an aqueous alkaline developer comprising at least one basic substance such as potassium hydroxide or sodium silicate, and one neutral salt such as sodium or potassium chloride. Examples of such developers include:

| Composition A | |
|---|---|
| sodium metasilicate $5H_2O$ | 30 g |
| Aerosol OS (Trade Mark) | 2.16 g |
| sodium chloride | 30 g |
| Water to | 1000 ml |
| **Composition B** | |
| sodium metasilicate $5H_2O$ | 4.0% |
| trisodium phosphate $12H_2O$ | 3.4% |
| monosodium phosphate | 0.3% |
| sodium hydroxide (reagent grade) | 0.7% |
| soft water | 1000 ml |

For the processing of graphic arts sheet materials, developers typically contain hydroquinone, together with alkali metal (sodium or potassium) carbonates, sulphites and bromides. These compositions are used at a pH level of typically from 10.5 to 13.5.

BRIEF DESCRIPTION OF THE DRAWINGS

The invention will be described by the following illustrative embodiments with reference to the accompanying drawings without the intention to limit the invention thereto, and in which.

DETAILED DESCRIPTION OF THE INVENTION

Figure 1:
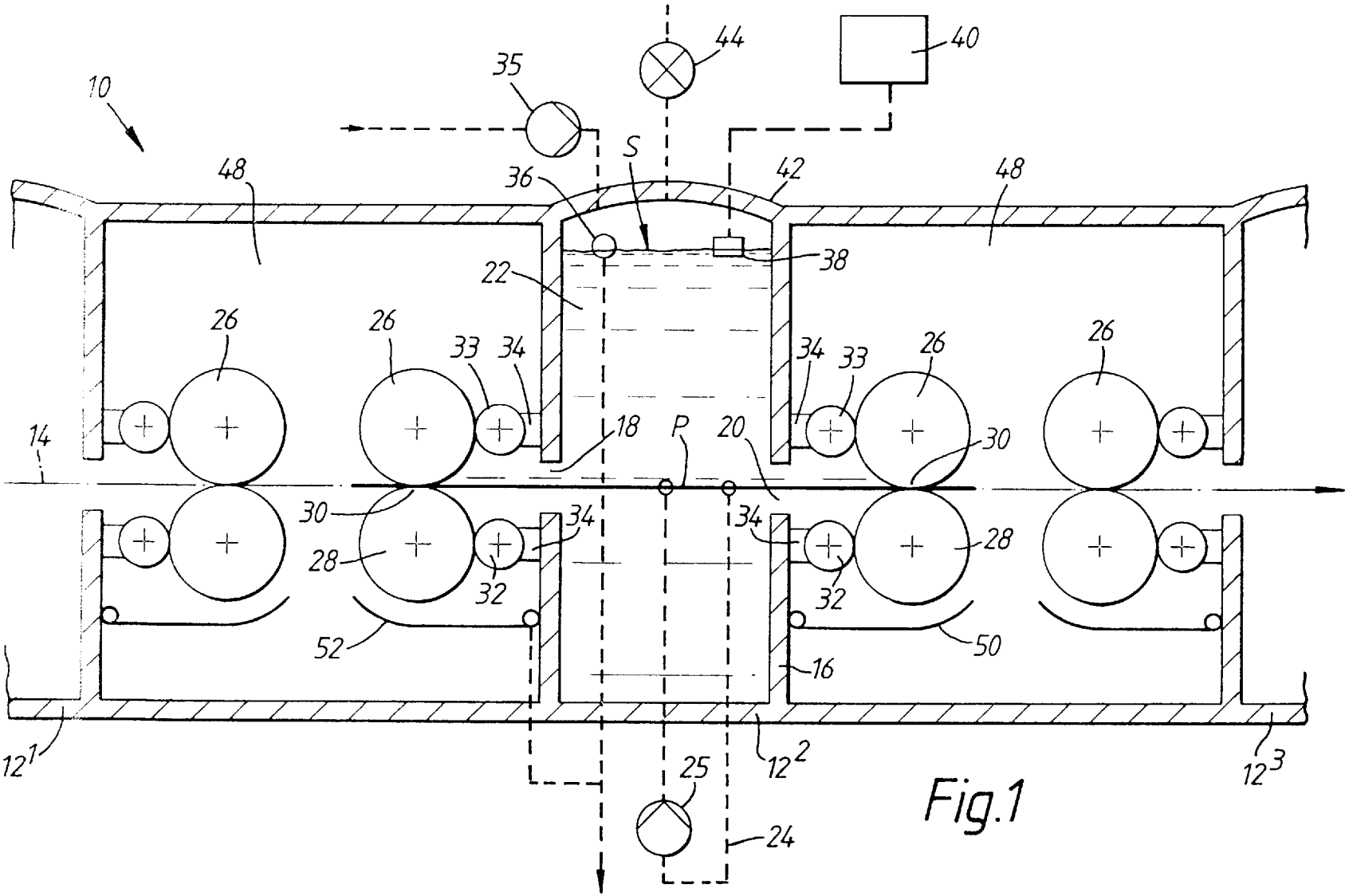
FIG. 1 shows a diagrammatical cross-section of a processing apparatus according to the invention.

As shown in FIG. 1, an apparatus 10 for the processing of photographic sheet material comprises a plurality of treatment cells $12^1$, $12^2$, $12^3$ mounted one beside another to define a substantially horizontal sheet material path 14 through the apparatus. In FIG. 1, cells $12^1$, and $12^3$ are only partly shown. The sheet material path 14 through the cells $12^1$, $12^2$, $12^3$ is substantially straight.

Referring in particular to cell $12^2$, it will be seen that each cell comprises a housing 16 having a sheet material inlet 18 and a sheet material outlet 20. Treatment liquid 22 having a static liquid level S is retained in the cell.

The housing 16 includes a treatment liquid circulation passage 24 located below the static liquid level S, liquid flow through the circulation passage being controlled by a circulation pump 25. Ideally, the circulation passage withdraws treatment liquid from the cell and returns it again to the cell approximately at the level of the nip plane.

The inlet 18 and the outlet 20 are each closed by a pair of rotatable path-defining rollers 26, 28. One of the path-defining rollers 26, 28 of each pair constitutes a drive roller for driving the sheet material along the sheet material path 14.

The path-defining rollers 26, 28 are biased into contact with each other to form a nip 30 there-between through which the sheet material path 14 extends.

Sealing rollers 32 in contact with the rotatable path-defining rollers 28 along the length thereof, are provided to seal each of the path-defining rollers 28 to the housing 16. Similarly, sealing rollers 33 in contact with the path-defining rollers 26 seal the latter to the housing 16. Each sealing roller 32, 33 is carried by a longitudinal bearing 34 constituting a stationary sealing member which seals the sealing roller to the housing 16. It will be seen that the sealing rollers 32, 33 contact the respective path-defining rollers 28, 26 at a position located 90° from the nip 30 on the liquid side.

A treatment liquid is fed to the cell by a pump 35. An overflow 36 provided in the housing 16 at the level S above the nip plane P is provided to define a static liquid level S above the nip plane P. Sensing means 38 are provided for sensing the level S of treatment liquid 22 in each the cell. Control means 40, responsive to the output of the sensing means 38, serve to adjust the level S of treatment liquid 22 in the cell to the required level S, by controlling the operation of the pump 35.

The housing 16 includes an upper portion 42 closing the cell from the outside. This upper portion 42 of the housing 16 includes a closeable valve 44, which can be opened to facilitate depressurising the cell.

Each cell is spaced from the next by a closed intermediate region 48. A first drip tray 50 is provided in the intermediate region below the nip 30 of the sheet material outlet 20 and a second drip tray 52 is provided in the intermediate region below the nip 30 of the sheet material inlet 18. Treatment liquid recovered from the drip trays 50, 52 may be recirculated, optionally by way of a silver recovery (e.g. electrolysis) unit.

Figure 2:
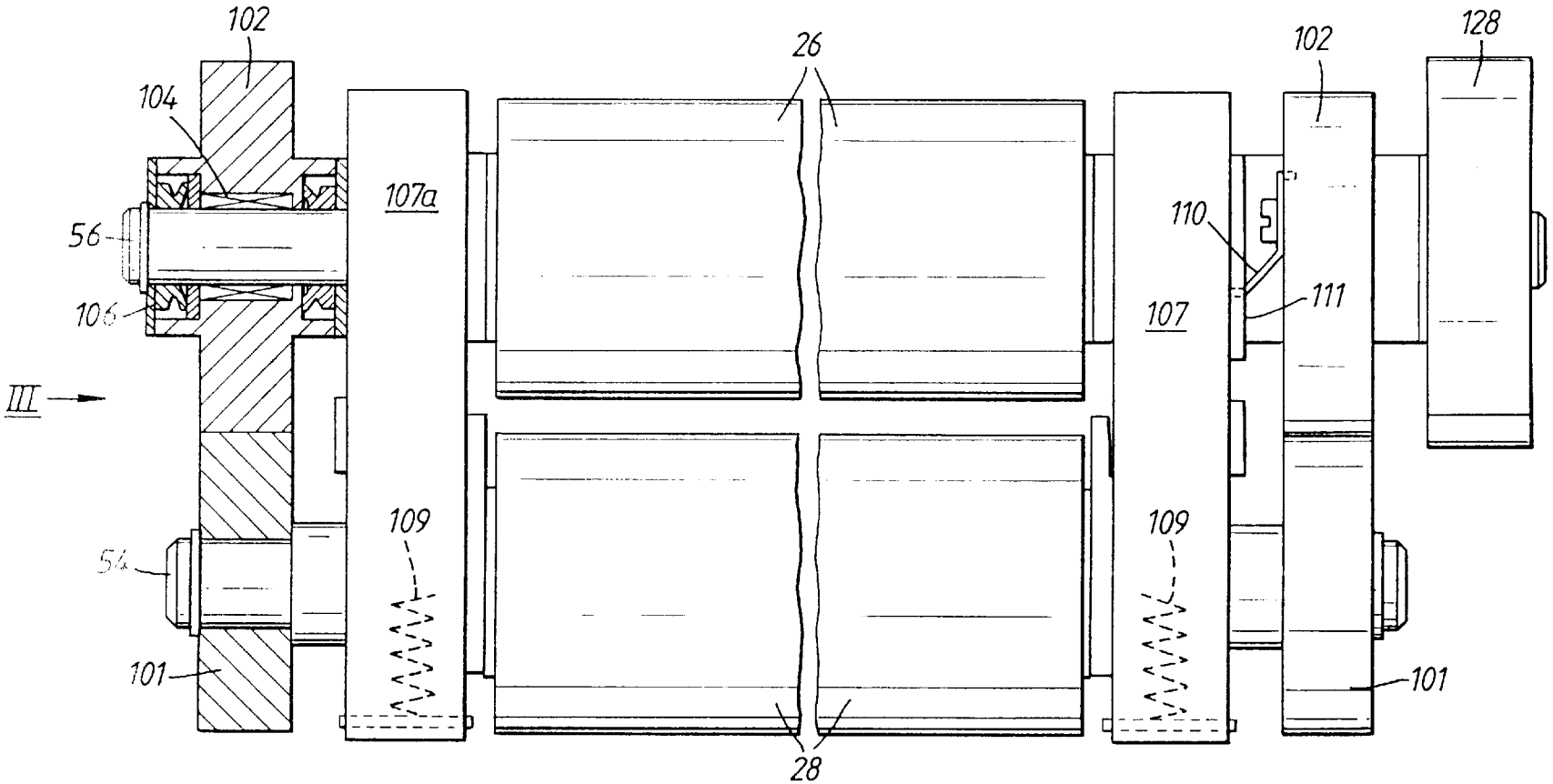
FIG. 2 is a plan view, partly cut-away, showing the valve operating mechanism associated with the apparatus shown in FIG. 1.

Referring to FIG. 2, the apparatus also includes an arrangement for selectively moving each of the path-defining rollers 26, 28 away from each other.

With reference to FIG. 2, each of the rollers is constructed by assembling the hollow cylindrical core covered with the elastomer, and fitted at each end of the core a rigid flange and a shaft, indicated by the references 54 and 56.

Figure 3:
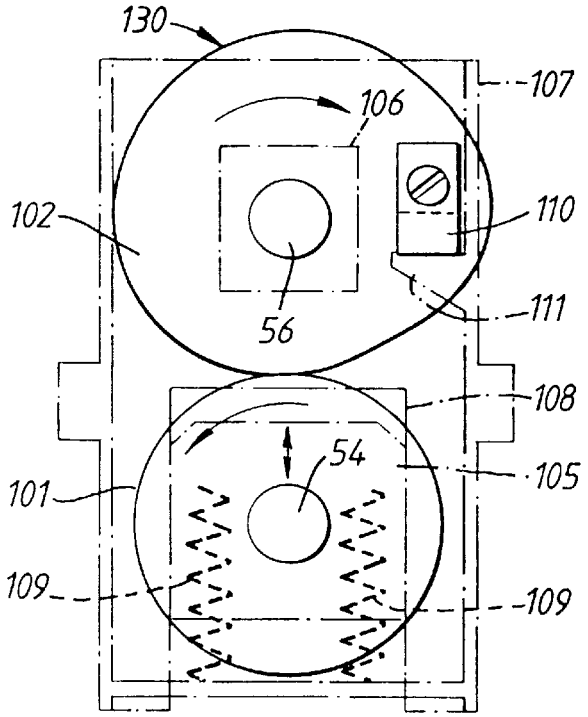
FIG. 3 is an end view, taken in the direction of the arrow III in FIG. 2, of the part of the roller operating mechanism shown in FIG. 2 in closed condition.
Figure 4:
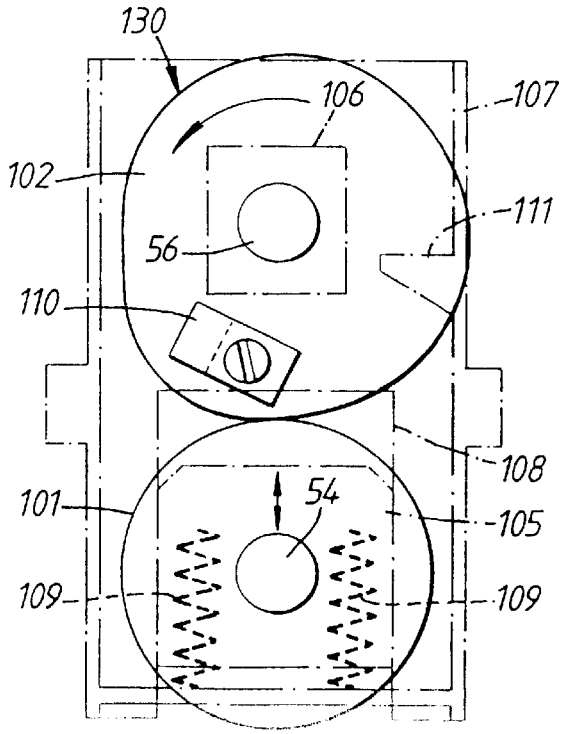
FIG. 4 is a similar end view of the part of the roller operating mechanism shown in FIG. 2 in open condition.

The roller opening mechanism is shown in FIGS. 2, 3 and 4. From FIG. 2 it will be seen that the rotation shafts 54, 56 of the first and second rollers 26, 28 respectively have cams 101, 102 secured thereto at each end thereof. The cams 101 on the first roller shaft 54 are circular and may be fixed for rotation with the shaft 54. If the cams 101 are made from an engineering polymer such as nylon or acetyl resin, then the cams 101 may be rotatable on the shaft 54 when no load is applied to the cams and will be held fixed on the shaft by friction when a load is applied to the cams 101. The cams 102 on the second roller shaft 56 are eccentric, and are secured on the shaft 56 through a one-way clutch or bearing mechanism 104 which allows the cams 102 to rotate relative to the shaft 56 in one direction (the "processing" direction), but locks the cams relative to the shaft 56 in the other direction of rotation (this is shown on one side of FIG. 2 only). The one-way mechanism 104 is sealed on the shaft 56 to prevent contamination. The rollers can be connected by gears, provided that the amplitude of the cam is smaller than the insertion depth of the gears.

The second roller 28 is a driven roller and the first roller 26 is an idle roller. The two roller shafts 54, 56 rotate in bearings 105, 106 respectively which are held in a pair of frames 107, 107*a* located one at each end of the rollers. The second roller 28 rotates in bearing 106 fixed in the frames 107, 107*a* and is rotated by a drive wheel 128 driven from an electric reversible step drive motor via transmission means, not shown. The motor is provided with an encoding disc system in order to control the speed and the progressing vertical position of the sheet material. The first roller 26 rotates in its bearings 105 and the bearings 105 slide in guides 108 in frames 107, 107*a* so that the first roller 26 is free to move towards and away from the second roller 28 as the bearings 105 move between the positions shown in FIGS. 3 and 4. Springs 109 bias the first roller 26 towards the second roller 28 by a force of up to 400N. The first roller 26 is free to move between 1 and 6 mm away from the second roller in order to open the valve.

Alternatively the elastomeric covering of the rollers provides the bias force between the rollers, the shaft ends abutting against fixed stops in the closed position. Spring forces may be used to open the rollers.

The eccentric cams 102 on the second roller 28 are held in an "at rest" position during the processing direction of rotation by an index clip 110 which rests against an abutment 111 on the respective frame 107. This sets the starting position for the operation of the eccentric cams 102 when second roller shaft 56 rotates in the opposite direction of rotation. For example, the rollers may be made to move apart over the first 180° to 210° of rotation of the second cam 102 relative to the first cam 101, be held apart at a preset distance for 60° of rotation, and then move together over the last 120° to 90° of movement.

Thus in FIG. 3 with the second roller 28 on shaft 56 rotating clockwise, i.e. in the processing direction, and the two rollers 26, 28 biased together by the springs 109, the first roller 26 on shaft 54 is driven anti-clockwise to pass sheet material through the rollers.

When the second roller 28 is driven clockwise, the cam 102 rotates on its one-way clutch 104 and is held stationary relative to the frame 107.

When the direction of rotation of the second roller 28 is reversed, i.e. to the roller-opening direction, the cam 102 now turns with the second roller and its cam surface 130 works against the circular cam 101 to push the first roller 26 against the bias of the springs 109 away from the second roller 28 (see FIGS. 2 and 4) to open the rollers and thereby allow the cleaning liquid above the height of the nip to pass out of the cell.

Although FIGS. 2, 3 and 4 show an arrangement whereby one path-defining roller moves while the other remains fixed in position, an arrangement is also possible whereby both path-defining rollers move.

Figure 5:
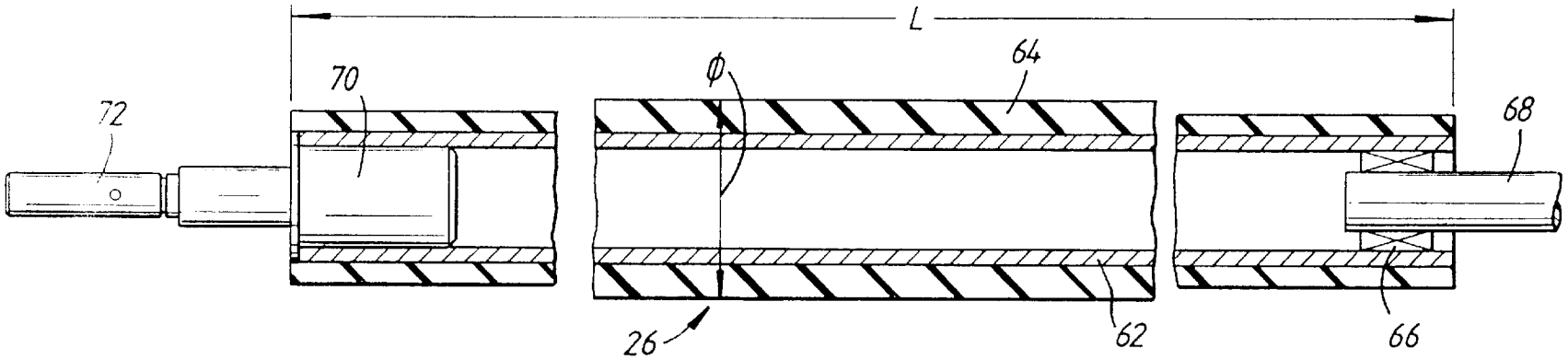
FIG. 5 is a longitudinal cross-sectional view showing the detail of the construction of one roller used in the vessel shown in FIG. 1.

The construction of roller 26 is shown in more detail in FIG. 5. The construction of roller 28 is similar. The roller 26 comprises a core 62 of stainless steel, having a constant outside diameter of 25 mm and an internal diameter of 19 mm. The stainless steel core 62 has a flexural E-modulus of 210 GPa. The core 62 is provided with a covering 64 of EPDM rubber, an elastomer having a hardness of 30 Shore (A). The core 62 has a thickness varying from 7 mm and the roller ends to 7.5 mm at the roller centre. The roller 26 has a length of 750 mm and a maximum diameter of 40 mm. The maximum $\phi/L$ ratio is therefore approximately 0.053.

FIG. 5 also shows two possible methods of mounting the roller, one at each end thereof. In practice, it will be usual to use one method only at both ends. At the right hand end of FIG. 5, an internal bearing 66 is provided in which a fixed shaft 68 locates, the shaft being fixedly carried in the apparatus. At the left-hand end of FIG. 5, a spindle 70 is fixedly retained in the hollow core 62 and has a spindle end 72 which extends into a bearing (not shown) in the apparatus, or carries a drive wheel thereon. This construction is suitable for that end of the roller which transmits the drive to the roller.

What is claimed is:

1. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing; and liquid level control means to define a static liquid level above the nip plane;

wherein at least one of said path-defining rollers comprises a rigid core carrying a covering of elastomeric material, the ratio ($\phi/L$) of the maximum diameter ($\phi$) of the elastomeric material covering to the length (L) thereof being at least 0.012.

2. An apparatus according to claim 1, wherein said sealing means contacts said path-defining roller at a position located less than 180° from said nip on the liquid side or on the non-liquid side.

3. An apparatus according to claim 2, wherein said sealing means contacts said path defining roller at a position located between 45° and 135° from said nip on the liquid side or on the non-liquid side.

4. An apparatus according to claim 1, wherein said reaction surface comprises a second rotatable path-defining roller.

5. An apparatus according to claim 4, further comprising second sealing means to seal each said second path-defining roller to said housing.

6. An apparatus according to claim 5, wherein said second sealing means are located below said static liquid level.

7. An apparatus according to claim 1, wherein each said sealing means comprises a rotatable sealing member in contact with each said rotatable path-defining roller along its length.

8. An apparatus according to claim 7, wherein each said rotatable sealing member comprises a sealing roller.

9. An apparatus according to claim 1, wherein said path-defining roller constitutes a drive roller for driving said sheet material along said sheet material path.

10. An apparatus according to claim 1, wherein said liquid level control means comprises a treatment liquid overflow provided in said housing at a static liquid level above said nip plane.

11. An apparatus according to claim 1, wherein said sheet material path between each said treatment cell and the next adjacent treatment cell is substantially straight.

12. An apparatus according to claim 1, wherein said at least one cell further comprises at least one of cleaning means for acting upon said path-defining roller to remove debris therefrom, additional rollers for transporting said sheet material through the apparatus, additional roller pairs for breaking laminar fluid at the surface of said sheet material as it passes through the apparatus, guide means for guiding the passage of the sheet material through the apparatus, liquid pumping means, liquid heating means, liquid cooling means and liquid filtering means.

13. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing; and liquid level control means to define a static liquid level above the nip plane;

one said cell being spaced from the next adjacent cell by a closed intermediate region wherein a first drip tray is provided in said intermediate region below the first nip of the one cell and a second drip tray is provided in said intermediate region below the second nip of the next adjacent cell.

14. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing, each said sealing means comprising a rotatable sealing member in contact with the associated path-defining rollers or reaction surfaces, said rotatable sealing member being carried by a longitudinal bearing constituting a stationary member;

liquid level control means to define a static liquid level above the nip plane; and said housing including an upper portion closing the cell from the outside and a treatment liquid circulation passage located below said static liquid level, said upper portion of said housing including means to facilitate depressurising said cell.

15. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing;

liquid level control means to define a static liquid level above the nip plane;

means for selectively moving each said path-defining roller away from said respective reaction surface; and said housing including an upper portion closing the cell from the outside and a treatment liquid circulation passage located below said static liquid level, said upper portion of said housing including means to facilitate depressurising said cell.

16. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing;

liquid level control means to define a static liquid level above the nip plane;

means for selectively moving each said path-defining roller away from said sealing means; and said housing including an upper portion closing the cell from the outside and a treatment liquid circulation passage located below said static liquid level, said upper portion of said housing including means to facilitate depressurising said cell.

17. An apparatus for processing photographic sheet material, comprising:

at least one treatment cell including a housing having a sheet material inlet and a sheet material outlet;

a first rotatable path-defining roller biased into contact with a first reaction surface to form a first nip therebetween and closing said cell on the sheet material inlet side;

a second rotatable path-defining roller biased into contact with a second reaction surface to form a second nip therebetween and closing said cell on the sheet material outlet side;

a sheet material path through the apparatus extending between the first nip and the second nip, said sheet material path being substantially horizontal and defining a nip plane;

means for sealing each of said first and second path-defining rollers and said first and second reaction surfaces to said housing;

liquid level control means to define a static liquid level above the nip plane, said liquid level control means comprising means for sensing the level of treatment liquid in each said cell and control means, responsive to the output of said sensing means, to adjust the static level of treatment liquid in said cell to a predetermined level; and said housing including an upper portion closing the cell from the outside and a treatment liquid circulation passage located below said static liquid level, said upper portion of said housing including means to facilitate depressurising said cell.

18. An apparatus for processing photographic sheet material, comprising:

a plurality of treatment cells mounted in a row, each said treatment cell including:

(i) a housing having a sheet material inlet and a sheet material outlet;

(ii) a first rotatable path-defining roller biased into contact with a first reaction surface to form a first nip therebetween and closing each said cell on the sheet material inlet side;

(iii) a second rotatable path-defining roller biased into contact with a second reaction surface to form a second nip therebetween and closing each said cell on the sheet material outlet side;

(iv) a sheet material path through the apparatus extending between the first nip and the second nip, said sheet material path being substantially horizontal and substantially straight and defining a nip plane;

(v) means for sealing each of said first and second path-defining rollers and said first and second reaction surfaces to the associated housing;

(vi) liquid level control means in each cell to define a static liquid level above the nip plane; and (vii) each said cell housing including an upper portion closing the cell from the outside and a treatment liquid circulation passage located below said static liquid level, said upper portion of said housing including means to facilitate depressurising said cell; and a closed entry region is provided in advance of the first treatment cell and a closed exit region is provided following the final treatment cell.

19. A method for processing photographic sheet material in an apparatus having a substantially horizontal sheet material path therethrough, comprising the steps of:

sealing a path-defining roller to a housing, said housing having a sheet material inlet and a sheet material outlet, each said inlet and outlet being closed by said path-defining roller biased into contact with a reaction surface to form a nip therebetween through which said sheet material path extends; and controlling a static liquid level above a nip plane, said nip plane defined by an extension of said sheet material path, wherein said path-defining roller comprises a rigid core carrying a covering of elastomeric material, the ratio ($\phi$/L) of the maximum diameter ($\phi$) of the elastomeric material covering to the length (L) thereof being at least 0.012.

20. A method according to claim 19, wherein during operation of the apparatus, the static liquid level is above the nip plane.

21. A method according to claim 20, wherein said sheet material is selected from the group consisting of x-ray film, one- and two-sheet DTR sheet materials, lithographic plates and graphic arts sheet materials.

* * * * *

UNITED STATES PATENT AND TRADEMARK OFFICE

CERTIFICATE OF CORRECTION

PATENT NO. : 6,102,588
DATED : August 15, 2000
INVENTOR(S) : Verlinden et al.

It is certified that error appears in the above-identified patent and that said Letters Patent is hereby corrected as shown below:

Title page,
Item [22] Filed: "Feb. 8, 1996" should read -- Feb. 6, 1997 --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*